United States Patent [19]

Gardenier et al.

[11] Patent Number: 4,860,392

[45] Date of Patent: Aug. 29, 1989

[54] HYDROTHERAPY MASSAGE UNIT

[76] Inventors: John Gardenier, 18 Cromer Ave., Schenectady, N.Y. 12304; John Maiuccoro, 40 Bentwood Crt., Albany, N.Y. 12203

[21] Appl. No.: 110,688

[22] Filed: Oct. 20, 1987

[51] Int. Cl.[4] ..... A61H 33/02

[52] U.S. Cl. ..... 4/542; 4/492; 128/66

[58] Field of Search ..... 4/542, 541, 544, 567–569, 4/591, 492, 96, 538; 128/66; 239/499, 505, 516, 517, 519

[56] References Cited

U.S. PATENT DOCUMENTS

| | | | |
|---|---|---|---|
| 493,194 | 3/1893 | Stifel et al. | 4/591 |
| 1,512,193 | 9/1924 | Berven | 4/591 |
| 2,714,725 | 8/1955 | Boone | 4/569 |
| 4,546,505 | 10/1985 | Wakenshaw | 4/543 |
| 4,563,782 | 1/1986 | Dijkhuizen | 4/541 X |

*Primary Examiner*—Stuart S. Levy
*Assistant Examiner*—Steven M. du Bois
*Attorney, Agent, or Firm*—Schmeiser, Morelle & Watts

[57] ABSTRACT

A hydrotherapy tub massage apparatus comprising a mixing chamber provided by the cooperative disposition of the human body with a surface of the hydrotub. Directional water ejectors for air inducting water ejectors are used to direct a stream of water or water and air essentially coplanar with the surface of the tub and into the chamber which is formed by the cooperative disposition of the human body with the surface of the tub. In one version, a flexible fabric is attached near the source of the ejected water or water and air flow so that it is disposed between the fluid flow and the body which is immersed in the hydrotub. The rapidly flowing water causes an undulation of the fabric and the concomitant massage effect is transmitted to the body.

7 Claims, 4 Drawing Sheets

FIG. 6
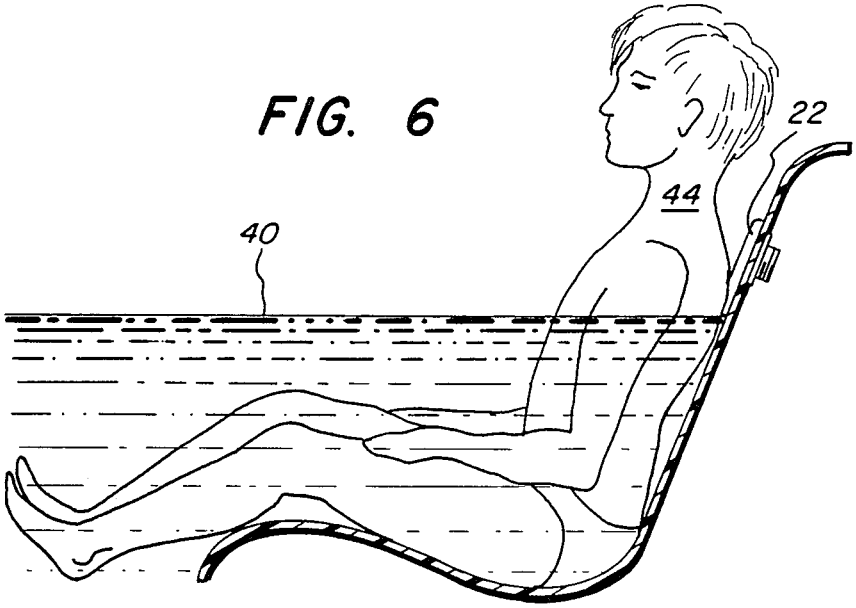
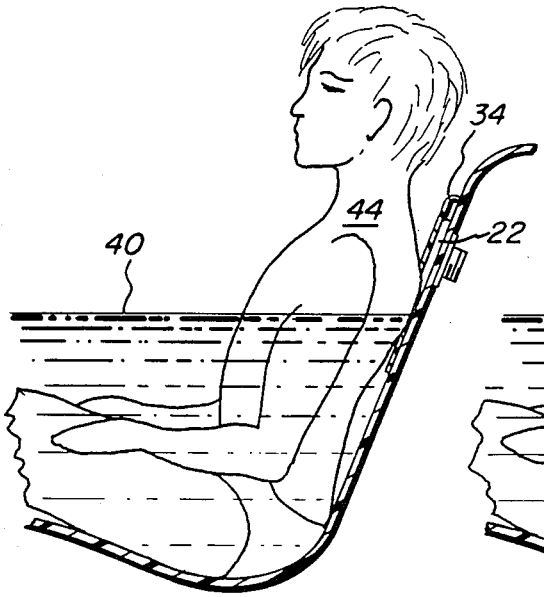
FIG. 7
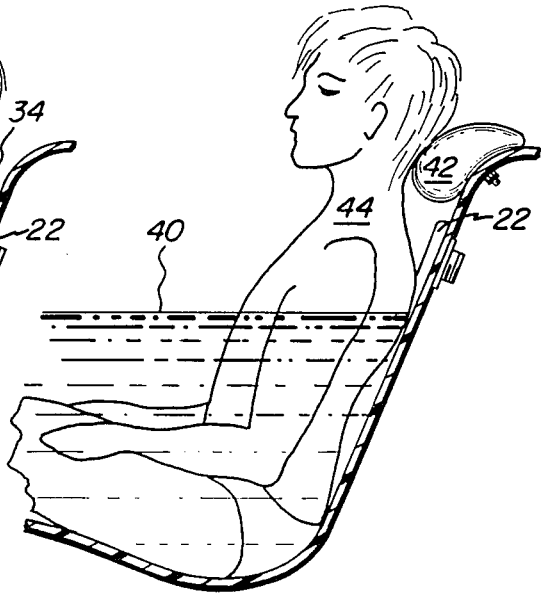
FIG. 8

HYDROTHERAPY MASSAGE UNIT

FIELD OF THE INVENTION

This invention relates generally to auxillary equipment for hot tubs and other forms of hydrotherapy appliances and, specifically to a novel water jet unit to be integrally constructed with a hydrotherapy appliance or to be retrofitted to hydrotherapy appliances not so equipped during their production.

BACKGROUND OF THE INVENTION AND PRIOR ART

Fitting hydrotherapy and hot tub appliances with ordinary water jet units or retrofitting older units, not so equipped, with the water jet devices is well known in the art. During the preparation of this disclosure an extensive search was performed in order to discover the relevant prior art that obtains in this particular field. Pertinent United States patents discovered were: U.S. Pat. Nos. 4,523,340 (Watkins, 1985); 4,546,505 (Wakenshaw, 1985); 4,304,740 (Cernoch, 1981); and 4,383,340 (Braun, Jr, 1983).

The patent issued to Watkins is the most pertinent of those discovered. Watkins teaches a "bubble" therapy that is employed in the instant invention. The Watkins water jet comprises a buoyant nozzle which simply adds air to an exhaust water stream to form a frothy ejecta for a hydrotherapy tub. The mechanism used to mix the air and water in the Watkins invention is essentially an ejector apparatus, a subject also well known in the art. Watkins employs a flexible air tube to introduce air into the outer cylindrical chamber of a nozzle. As the liquid motive fluid passes out of its source into the chamber, it entrains the air, lends a higher degree of buoyancy to the chamber which, in turn, rises in relation to the water level of the hydrotub and throughout the ejection operation is ejected as an air/water mixture from the rising and descending chamber. The novel aspect of the Watkins invention is the means and manner whereby the invention's exhaust water tube undulates as it expels the air/water mixture.

The invention of Wakenshaw is relevant in that the air/water mixture which it ejects is allowed to egress through a plurality of ports that are situated in groove-like conduits that run principally along the bottom of the tub. Whereas the Watkins invention inculcated moving apparatus as its principal feature, the Wakenshaw invention has no moving parts in its ejection mechanism. Wakenshaw however differs significantly from the invention of the instant inventors in that the air/water ejecta of Wakenshaw is emitted entirely below the water level of the tub. Further, Wakenshaw is primarily concerned with the portability of an inflatable spa and gives no particular attention to the groove-like conduits of the tub.

The Liquid Aeration apparatus of Cernoch is significant in that, in this apparatus, the air ejector principle is employed by an underwater jet of water entraining air through a snorkle-like device, i.e., the source of air is distinct from the source of water and, moreover, is located above the water level of the tub. To a small degree, this invention appears to employ one of the functional aspects of the instant inventors'.

The retrofit apparatus of Braun can more appropriately be described as an appliance for creating a whirlpool bath which is fitted into an existing tub space. The significant aspect of the Braun teaching is the use of a semi-tubular recessed surface intersecting a wedge-shaped recessed surface in the tub shell (that is to be) fitted into the original tub space. Further, the apertures are receptive of water jet nozzles that are designed to enhance the pressure and turbulence of water flowing from those nozzles and to distribute the turbulent water against the back of a person reclining against the supportive surfaces. Conspicuously absent from the invention and the teaching thereof is any expression or implication that the apertures or recessed surfaces act, or cooperate with the body, or function in any manner than that of mere channels. It is at this point, with the Braun disclosure as well as the aforementioned pertinent inventions, that the instant inventors would distinguish and disclose their novel hydrotherapy massage unit which may be built integrally with a hydrotherapy tub appliance or retrofitted to any existing tub appliance.

At the time of the instant invention, the inventors, designers and producers of hydrotherapy tubs, hot tubs and auxiliary equipment, determined that there existed in the applicable field no simply constructed, easily fitted or retrofitable froth/bubble ejector unit. Further, but for the placement of the human body within proximity of a water jet, there has been no teaching that the human body might in some way be employed cooperatively so as to acquire a therapeutic value from an inexpensive, simply constructed bubble massage unit.

SUMMARY OF THE INVENTION

The instant inventors have developed a hydrotherapy massage unit of the froth or bubble type which clearly overcomes the limitations of the prior art, particularly in the respect that such prior art does not provide an easily constructed, retrofitable, froth/bubble-type ejector unit for hydrotherapy tubs. This invention is the novel combination of a hydrotherapy tub with coplanar ejector means which comprises a simple water jet providing in particular manner a water stream or froth or bubble stream. Additionally, and most significant of this invention's aspects, the froth stream is purposefully directed coplanar with the surface of the tub, generally the seat back rest surface. Interposed between the body resting against the ejection surface and the ejecta stream is a thin, flexible fabric. The turbulence of the stream causes a rapid undulation of the fabric, the therapeutic and the vibratory massage being then transmitted directly to the body with which it is in contact. In the primary, most economical version of the same embodiment, a water stream only is ejected from the unit, coplanar to the tub surface. In this version, the back of the patient (the human body) is placed in registry with the ejector vent so that the water stream is directed down the patient's back, along the spine. A requirement of this version is that the ejector port be physically located at or above the water line and, preferably, below the nape of the patient's neck. As the water ejecta planes down the tub surface, air is entrained from the area essentially encompassed by the patient's shoulder blades and upper shoulder area. The induction of the air by the water stream creates the froth, the therapeutic effects of which may be enhanced, in this primary version, by the provision of at least one colinear channel or longitudinal supression in the tub surface. Such a channel or depression should be essentially colinear with the patient's body and, depending upon its width, could be of varying depth. As the froth dissipates the energy of ejection, bubbles will continue to rise about the body imparting a pleasant and soothing effect to the patient.

The first of the aforementioned versions is the apparatus which has particular applicability in the retrofit situation. That is not to say, however, that the second version may not be employed. It is conceivable with the second version that, since only a warm water stream is required, the ejector could be coupled directly to the hot water source of an ordinary bath tub. As long as the geometric parameters are satisfied, the second version would provide a patient immersed in an ordinary bath tub a good deal of the therapeutic benefits of the instant invention. In cases where the human/tub surface cooperation cannot be successfully achieved, the first version would be indicated and, if necessary, air entrainment may be omitted. In such a variation, however, it is obvious that the soothing effect of rising bubbles or froth may be lacking to some degree.

In addition to the advantages of the present invention, as well as the combinations suggested herein, many others will no doubt become apparent upon a study of the drawings and following descriptions.

BRIEF DESCRIPTION OF THE DRAWINGS

Of the Drawings:

FIG. 6 is a drawing disclosing the use of the human/-surface cooperative feature;

FIG. 7 is a drawing showing the use of the preferred embodiment with undulator; and FIG. 8 is a drawing displaying the use of the water ejector in cooperative relationship with a user.

DETAILED DESCRIPTION OF THE DRAWINGS

Figure 1:
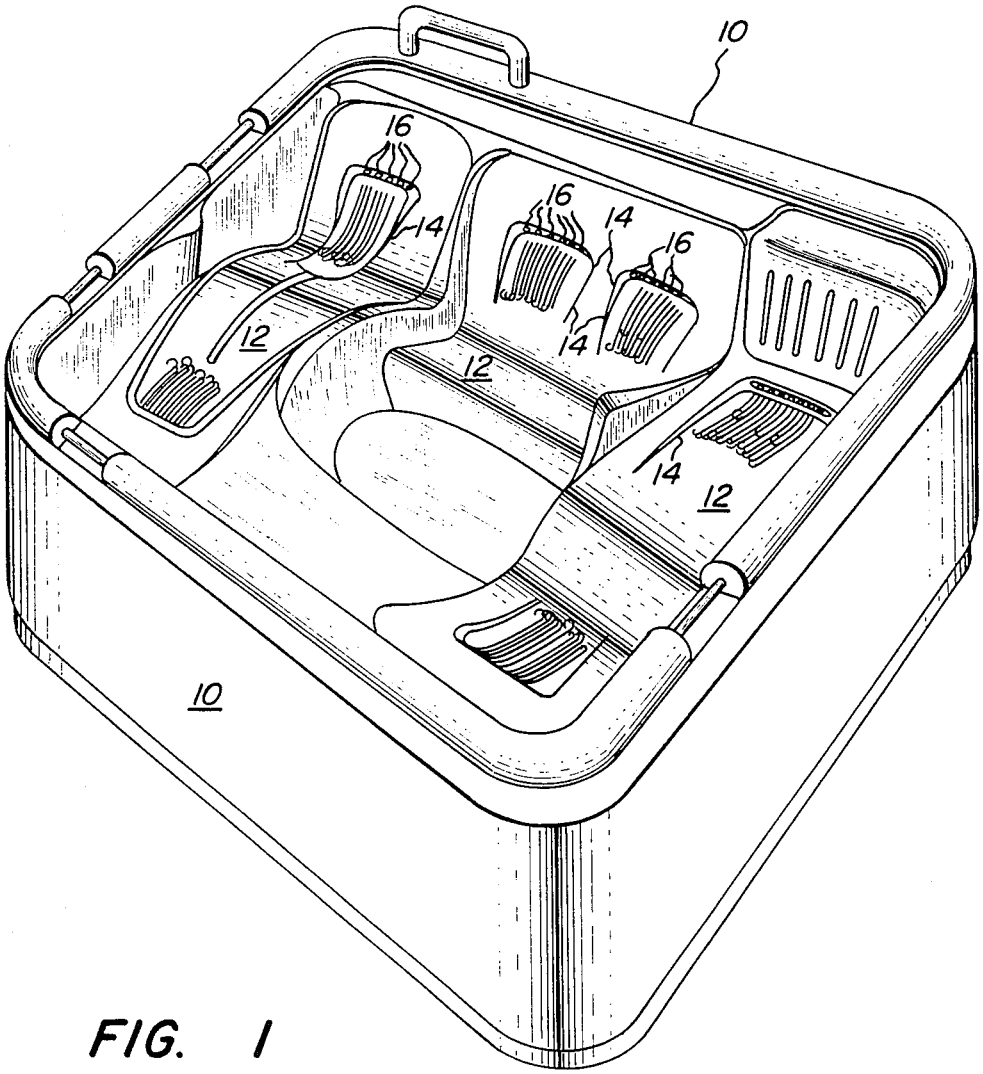
FIG. 1 is a isometric illustration of a hot tub containing a built-in version of the invention.

FIG. 1 depicts a conventional hydrotherapy tub 10 which has been partitioned in three sections 12 to accept the human body in various sitting and reclining postures. Readily apparent in this illustration are grooves or channels 14 which are recessions in the major surfaces 12. In one version of this preferred embodiment, the channels 14 are employed to enhance the bubble or froth therapy by directing the flow colinear to the body that is situated in the particular area. At the uppermost portion of these channels, vents or ejection ports 16 are seen dispensing either a water or water/air (froth) mixture.

Figure 2:
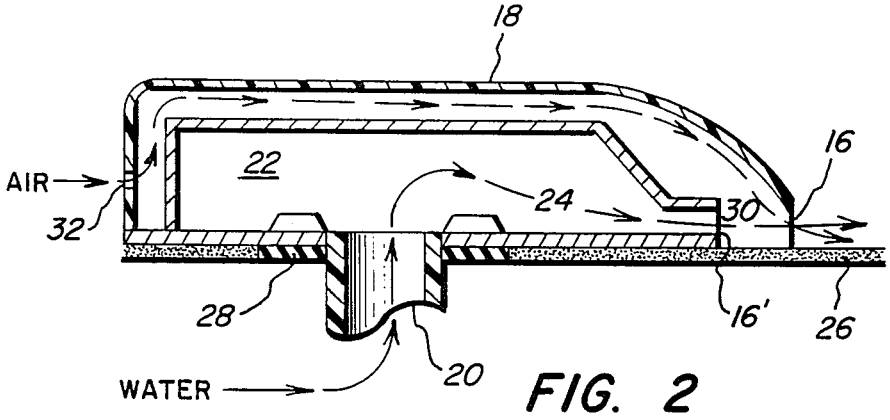
FIG. 2 is a cross-sectional side view of the froth ejector.
Figure 3:
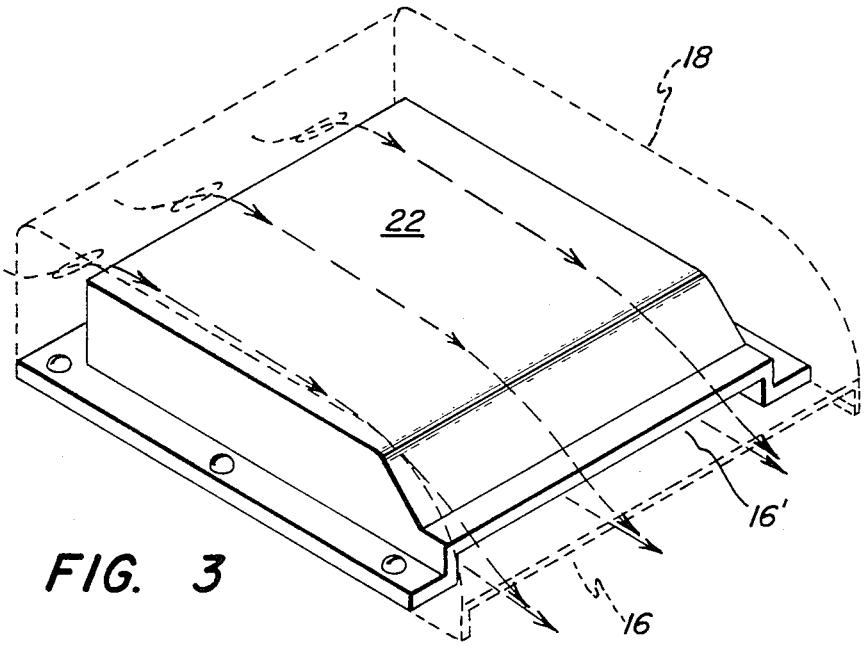
FIG. 3 is an isometric cut-away view of the froth ejector.

Reference being had now to FIG. 2 in conjunction with FIG. 3, there is illustrated a major object of the re-fit or retrofitting, the ejector 18. In the cross-sectional side view of FIG. 2, the ejector 18 is seen comprised of a water inlet 20 and a water chamber 22 which diverts the flow of water 24 essentially orthogonal to the inlet stream so that it will become coplanar with tub surface 26 as it is ejected through port 16, 16'. Enveloping water chamber 22 is air jacket 18. The sole purpose for air jacket 18 is to provide a source of air at the point that water is ejected through port 16'. The air/water mixing chamber 30 is depicted here only for reference and, in one version of the preferred embodiment is not employed by use of the air jacket 18. However, as illustrated in FIG. 2, air jacket 18 envelopes water chamber 22 and draws its principal supply of air from air port 32. The air/water mixture is ejected, as mentioned above, from port 16. Gasket 28 is provided so that a proper seal may be made between the unit and the tub surface 26, but it should be apparent from the drawings, and the subsequent discussion of the unit's usage, that it will rarely become a necessity.

FIG. 3, displaying the air jacket 18 invisibly, is an illustration of the preferred retrofit device, the water chamber ejector 22. The manner in which the device of FIG. 3 is best employed can be seen in the following drawings.

Figure 4:
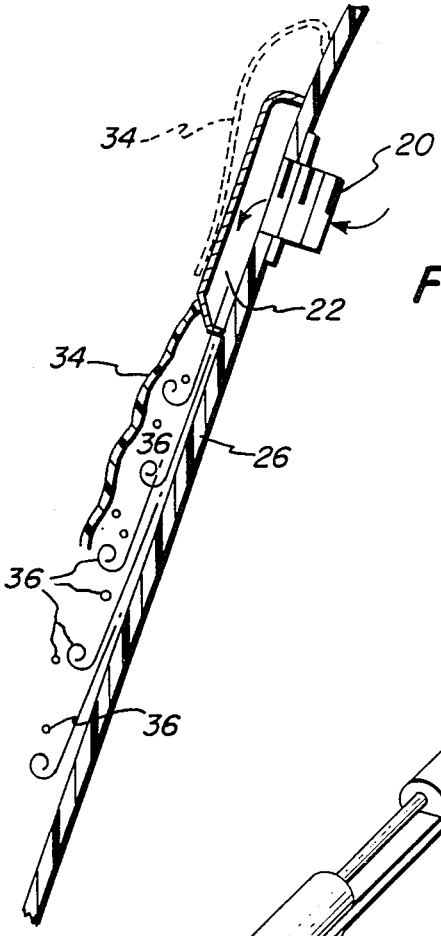
FIG. 4 is a sectional side view of a water or froth ejector with undulator.
Figure 5:
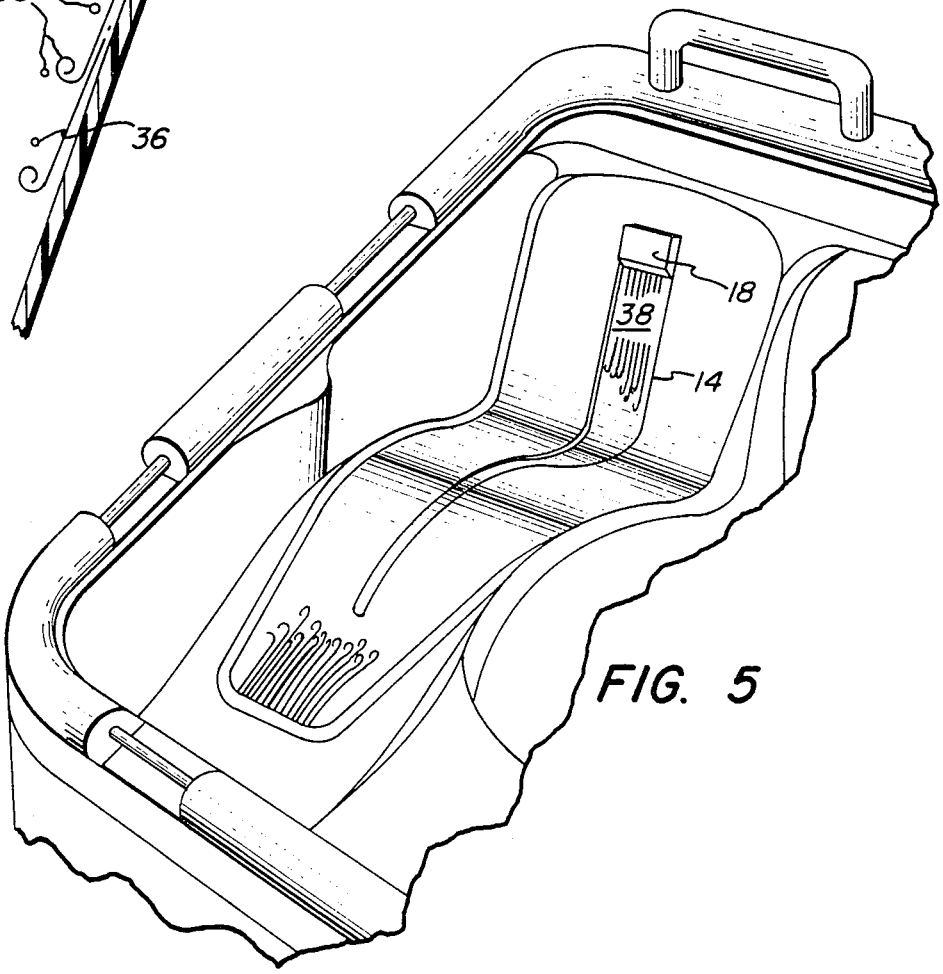
FIG. 5 is a partial isometric view of a hot tub with the preferred embodiment installed therein.

The use of undulator 34 as depicted in FIG. 4, concurrent with its attachment either directly to waterejector 22 or proximate it as depicted by the phantom illustration, is the simplest version of the preferred embodiment and the easiest adaptable to retrofit operations. The float 36 being emitted in FIG. 4 depicts not a froth but a turbulent water stream which is causing the dissociation of air from the water in which it is normally dissolved. Referring more particularly to FIG. 5, the invention of FIG. 2 is displayed and the ejecta 38 is a true air/water froth. The reader will note that a channel 14 has been included in this construction; as it represents a new production model developed by the inventors. That is not to say however, that the channel 14 is required in this product. The version disclosed in FIG. 4 would also be suitable for use in the FIG. 5 production.

FIGS. 6, 7 and 8 are drawings of a person immersed in the hydrotub with the water level 40 at approximately shoulder height. The invention is depicted as situate in an area just above the shoulder blades, so that the ports 16 (not shown) would reside just at or near the water level. The ejectors shown may be either froth or only water ejectors. FIG. 6 illustrates how either may be postured so as to derive the maximum therapeutic effect of the froth that would either be ejected from an air/water froth ejector, or an only water ejector. For the remaining portion of this disclosure only the solely water ejector 22 will be discussed; however, it should be understood that in every situation where the water only ejector 22 is employed, the froth ejector 18, 22 may be equally effective.

The sole difference between FIGS. 6 and 8 is the use of headrest 42 which may be required with some persons in order to provide the proper air induction chamber at the base of the neck and between the shoulder blades of the person 44. This facility must be obtained in order to achieve the true human/ejector surface cooperation that is the principle of the invention. The apparatus depicted in FIG. 7, that is, the use of undulator 34 is in reality an alternative to the applications of FIGS. 6 and 8, particularly if the water level 40 is too high to obtain the proper cooperative air induction, explained above.

The foregoing description of the instant invention, particularly by means of differing structural suggestions, is presented in order to inform the reader and stimulate innovation using the invention. Thus, the aspects disclosed are not means as a limitation on the art and it is anticipated that modifications may hereinafter be made by those skilled in the art. Variations and improvements of this invention shall be limited only by the matter circumscribed in the appended claims.

What is claimed:

1. A hydrotherapy tub massage apparatus comprising a mixing chamber which is provided by the cooperative disposition of a human body with a nearly vertical surface of said tub and further comprising:

a directional water ejector for directing a stream of water in a flow coplanar to said surface of said tub, said ejector's discharge port attached to said tub proximate the high water line;

a surface of said tub having facility for attaching thereto said ejector so as to allow said coplanar flow with said surface, said tub allowing immersion of a human body and comfortable placement of said body adjacent said flow so as to form said mixing chamber and compelling said flow to move between said body and said surface and to entrain air from above said high water line; and a flexible fabric attached near the source of said flow which is being ejected from said ejector, said fabric disposed between said body and said flow, whereby water ejecta flowing across said surface entrains air, causes said flow to become turbulent and thereby imparts a rhythmic, undulating movement to said fabric which in turn massages portions of the body placed in said cooperative relationship therewith.

2. The invention of claim 1 wherein said surface further comprises channeling means, said channeling means coextensive with the direction of said flow.

3. The invention of claim 2 wherein channeling means further comprises at least one groove in said surface oriented essentially along the axis of said flow.

4. The invention of claim 2 wherein the surface of said groove undulates so as to disrupt, below said high water line, said coplanar flow.

5. A method of massage for adaptation to a hydrotherapy tub comprising the steps of:

providing a mixing chamber by cooperative disposition of a human body reclining against a seat back rest surface of said tub so that, because of the essentially non-planar human surface juxtaposed the relatively flat planar seat back rest surface of said tub, a chamber may be established therebetween;

directing forcefully a stream of water essentially coplanar with said seat back rest surface into said chamber from above the water line in said tub so that the rapid stream of the directed water flow will entrain air and become a turbulent air-water mixture as it is impelled into said chamber and flows in contact simultaneously with both a human body and the seat back rest surface of the tub; and interposing a flexible fabric immediately adjacent said body and between said turbulent air-water flow so that the turbulent force of said flow will be communicated to said fabric which, enhances the massaging effect of the apparatus employing said method.

6. In a hydrotherapy tub having a seat back rest surface, a head rest surface immediately above the top of said seat back rest surface, and water recirculating means, the combination of coplanar ejector means comprising a directional water ejector which is comprised of a base disposed on a flat tub surface, water chamber means disposed over said base for confining water therein, said water chamber means having at least one lateral port therein with said port exit plane parallel to said base and disposed coplanar said tub surface, and conduit means into said ejector so that the water is expelled therefrom through said port parallel to and coplanar with said base, said directional water ejector secured to the tub above the normal tub fill level and adjacent to the upper end of the seat back rest surface so as to be disposed in registry below the nape of a user's neck, said ejector positioned to deliver and direct a strong, rapid stream of water in coplanar flow from proximate said head rest surface down the seat back rest surface, and an air jacket disposed on said base and enveloping said water chamber means, said air jacket including an air/water mixing chamber adjacent the lateral port for entraining air into said flow to effect a turbulent stream as the water air mixture moves down said back rest.

7. A hydrotherapy tub of claim 6 in which an elongated channel is disposed in and extends longitudinally of the seat back rest surface to further confine said water by receiving and guiding said coplanar flow of water in coplanar flow lengthwise of the seat back rest surface, in which said water ejector is mounted on the tub at the upper end of the elongated channel immediately below said head rest surface.

* * * * *